US010759079B2

(12) United States Patent
Smithwick

(10) Patent No.: US 10,759,079 B2
(45) Date of Patent: Sep. 1, 2020

(54) ROTARY CUTTING DIE APPARATUS FOR CUTTING CORRUGATED BOARD INCLUDING RETAINERS FOR MAINTAINING TRIM STRIPPERS CLOSELY ADJACENT TRIM CUTTING BLADES

(75) Inventor: James M. Smithwick, Holly Springs, NC (US)

(73) Assignee: Container Graphics Corporation, Cary, NC (US)

( * ) Notice: Subject to any disclaimer, the term of this patent is extended or adjusted under 35 U.S.C. 154(b) by 1537 days.

(21) Appl. No.: 12/708,697

(22) Filed: Feb. 19, 2010

(65) Prior Publication Data

US 2011/0203435 A1 Aug. 25, 2011

(51) Int. Cl.

| | |
|---|---|
| ***B26F 1/44*** | (2006.01) |
| ***B26F 1/38*** | (2006.01) |
| ***B26D 7/18*** | (2006.01) |
| ***B31F 1/10*** | (2006.01) |
| ***B31B 50/25*** | (2017.01) |
| ***B31B 50/14*** | (2017.01) |

(52) U.S. Cl.

CPC ..... *B26F 1/44* (2013.01); *B26D 7/1818* (2013.01); *B26F 1/384* (2013.01); *B31F 1/10* (2013.01); *B31B 50/146* (2017.08); *B31B 50/256* (2017.08); *Y10T 29/49826* (2015.01); *Y10T 83/2103* (2015.04); *Y10T 83/4838* (2015.04)

(58) Field of Classification Search

CPC ..... B26D 7/1818; B26D 7/01; B26D 7/015; B26F 1/384; B26F 1/44; B26F 1/20; B26F 1/0023; B26F 1/00; Y10T 83/2103; Y10T 83/4838; B31B 50/20; B65B 61/08

USPC ..... 83/114, 117, 118, 128

See application file for complete search history.

(56) References Cited

U.S. PATENT DOCUMENTS

| | | | | |
|---|---|---|---|---|
| 2,674,929 | A * | 4/1954 | Wittkuhns et al. | 493/74 |
| 4,499,802 | A | 2/1985 | Simpson | |
| 4,784,031 | A * | 11/1988 | Dixon | B26D 1/626 101/117 |
| 4,968,292 | A * | 11/1990 | Takeda | F16D 1/101 403/359.6 |
| 5,111,725 | A | 5/1992 | Simpson | |
| 6,162,155 | A * | 12/2000 | Gordon | B31B 1/00 493/365 |
| 6,280,373 | B1 * | 8/2001 | Lanvin | B26D 7/025 493/194 |
| 6,490,949 | B2 | 12/2002 | Simpson | |

(Continued)

FOREIGN PATENT DOCUMENTS

| | | |
|---|---|---|
| GB | 2335880 | 6/1999 |
| GB | 2335881 | 6/1999 |

*Primary Examiner* — Jason Daniel Prone
*Assistant Examiner* — Samuel A Davies
(74) *Attorney, Agent, or Firm* — Coats & Bennett, PLLC

(57) ABSTRACT

A rotary cutting die assembly is provided that includes a die cylinder, an anvil, and a die board mounted to the die cylinder. The die board includes a series of trim cutting blades. Disposed on the outside of each trim cutting blade is a trim stripper. Secured to the die board adjacent the outside of the trim strippers is a series of retainers that generally retain the trim strippers between trip cutting blades and the retainers. This generally prevents cut pieces of trim from being packed and wedged into a gap between the trim cutting blades and the trim strippers.

14 Claims, 11 Drawing Sheets

(56) References Cited

U.S. PATENT DOCUMENTS

| | | | | |
|---|---|---|---|---|
| 6,688,198 | B2 * | 2/2004 | Matsumoto | B26D 1/0006 83/139 |
| 6,925,918 | B1 * | 8/2005 | Bunge | 83/116 |
| 7,017,463 | B1 * | 3/2006 | Simpson | B26D 7/1818 493/472 |
| 7,111,534 | B1 | 9/2006 | Simpson | |
| 8,166,858 | B2 † | 5/2012 | Luquette | |
| 8,201,482 | B2 * | 6/2012 | Vossen | B26D 7/025 76/107.8 |

* cited by examiner
† cited by third party

ROTARY CUTTING DIE APPARATUS FOR CUTTING CORRUGATED BOARD INCLUDING RETAINERS FOR MAINTAINING TRIM STRIPPERS CLOSELY ADJACENT TRIM CUTTING BLADES

FIELD OF THE INVENTION

The present invention relates to rotary cutting dies for cutting and scoring corrugated board, and more particularly to a rotary cutting die having trim cutting blades and trim strippers for engaging cut pieces of trim and directing them away from the rotary cutting die.

BACKGROUND OF THE INVENTION

Rotary cutting dies are commonly used for producing a container or carton blank from corrugated board sheet material. Such rotary dies are typically comprised of a die cylinder, a die board mounted on the die cylinder and including cutting blades and scoring rules, and an anvil mounted adjacently the die cylinder and the die board. A nip is defined between the die board and the anvil and sheets of corrugated board are fed into the nip. As the corrugated board is fed through the nip, the cutting rules, scoring rules and other devices and elements mounted on the die board engage and operate on the corrugated board passing through the nip and between the die board and the anvil.

Most die boards are designed to trim the corrugated board along surrounding edges as the corrugated board passes through the nip. To accomplish this, the die board is provided with a series of trim cutting blades. Also mounted to the die board adjacent the outside of the respective trim cutting blades is elastomer trim transfer devices or trim strippers. The trim strippers are compressible and resilient. During the trim cutting process, the trim strippers engage the cut pieces of trim as they pass through the nip and hold the cut pieces of trim against the anvil for a short period of time. The trim strippers function to separate the cut pieces of trim from the resulting product board.

Over a period of time, the trim strippers or trim transfer devices tend to separate and move away from the adjacent trim cutting blades. That is, as the trim strippers are compressed and passed through the nip, it is common to find that they tend to bow and as they bow, a small gap occurs between the trip strippers and the adjacent trim cutting blades. Once this gap occurs, it is common for small pieces of cut trim to become lodged or packed in the gap. Over a period of time, this cut trim becomes more compact and is effectively driven down between the trim strippers and the trim cutting blades. The forces placed on the cut pieces of trim can be so great that they damage and even break the die board.

SUMMARY OF THE INVENTION

The present invention relates to a rotary cutting die that is adapted to be mounted on a rotary die cylinder for cutting corrugated board fed between the cutting die and an anvil. The rotary cutting die includes a die board and a plurality of trim cutting blades mounted on the die board. Trim strippers or trim transfer devices are secured on the die board adjacent the trim cutting blades and functions to engage cut pieces of trim and urge the cut pieces of trim away from the trim cutting blades. A retainer is mounted on the die board closely adjacent the trim strippers such that the trim strippers are confined and disposed between the retainer and the trim cutting blades. By confining the trim strippers between the retainer and trim cutting blades, the trim strippers are maintained closely adjacent the trim cutting blades such that a gap does not occur between the trim strippers and the trim cutting blades. This generally prevents cut pieces of trim from becoming jammed or packed between the trim strippers and the trim cutting blades.

In another embodiment of the present invention, there is provided a preloading device mounted on the die board ahead of a leading trim cutting blade. The preloading device engages the anvil during the process of trimming and cutting corrugated board and preloads the rotary die cylinder that the die board is mounted on prior to the leading trim cutting blade loading the die cylinder. This preloading device tends to gradually load the die cylinder as opposed to abruptly loading the die cylinder which may occur when the leading trim cutting blades engage the corrugated board. By gradually loading or preloading the die cylinder as contrasted with abruptly loading, upstream printing operations are made more efficient and generally typical problems associated with ink smudging is avoided.

DETAILED DESCRIPTION

With further reference to the drawings, a rotary cutting die apparatus is shown therein and indicated generally by the numeral 30. As is appreciated by those skilled in the art, the rotary cutting die apparatus 30 is designed to receive sheets of corrugated board CB and to trim the sheets of corrugated board to yield a product board. Further, the rotary cutting die apparatus 30 is designed to cut, score, and in some cases remove scrap from areas of product board. In the end, the rotary cutting die apparatus 30 is designed to treat and condition the corrugated board such that when the corrugated board exits the rotary cutting die apparatus, the product board can be easily manipulated into a box configuration.

Figure 1:
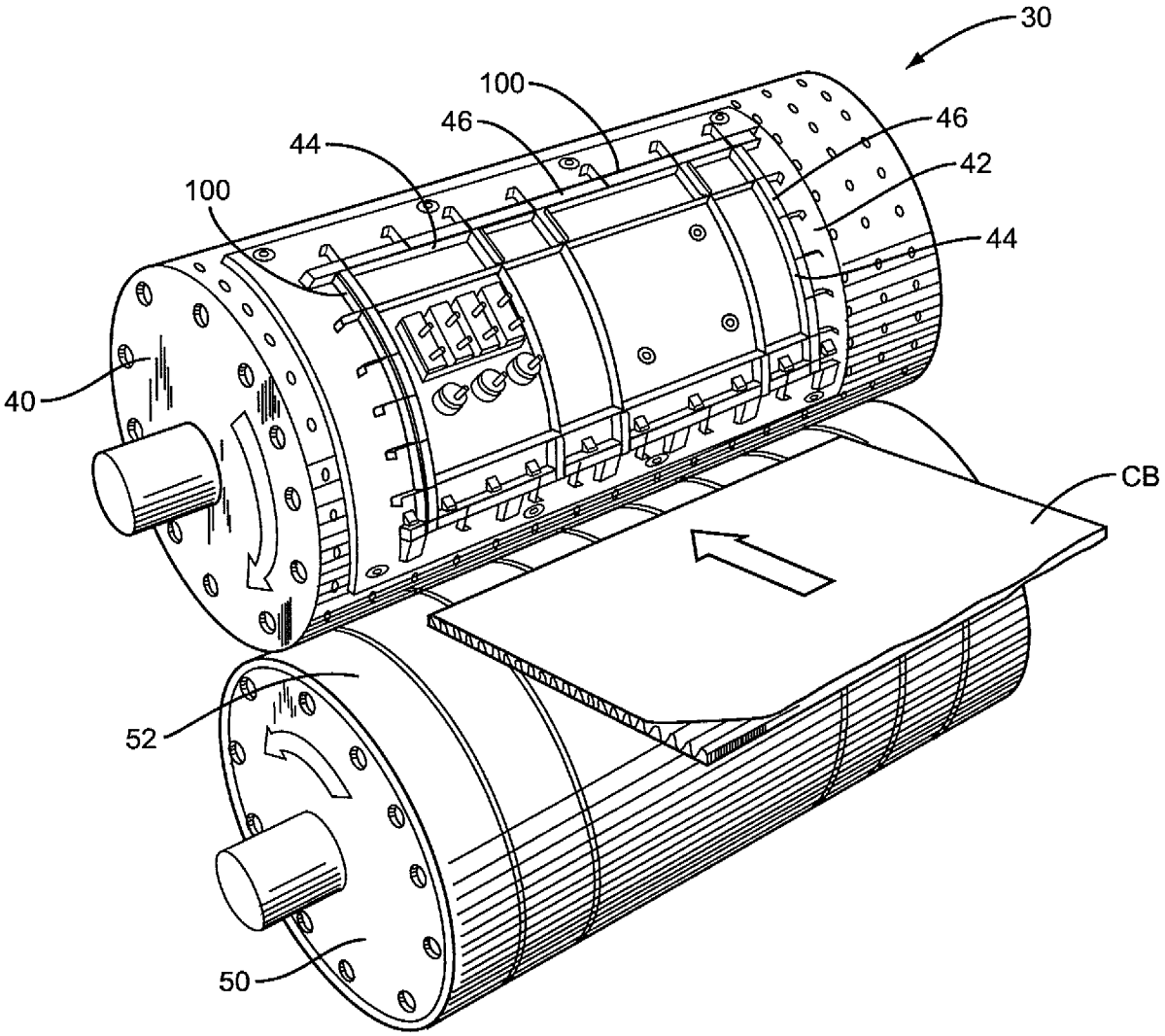
FIG. 1 is a perspective view of a rotary cutting die apparatus showing trim cutting blades, trip strippers and retainers for maintaining the trim strippers in close proximity to the trim cutting blades.

With reference to FIG. 1, the rotary cutting die apparatus 30 includes a die board cylinder 40 and an anvil cylinder 50. As will be appreciated from subsequent portions of the disclosure, the die board cylinder 40 is designed to receive and hold a die board 42. The die board cylinder 40 including the die board 42 is disposed with respect to the anvil cylinder 50 such that a nip is defined there between. As sheets of corrugated board are fed through the nip, corrugated board is engaged by the die board 42 which trims, cuts and scores the corrugated board. The anvil cylinder 50 is typically surrounded or sheathed with a surface layer or coating 52 of a relatively compliant material such as urethane, which provides a backing surface against which a cut can be made without damaging various components carried by the die board 42. As such, anvil cylinder 50 rotates in a manner that is generally synchronous with the adjacent die board cylinder 40 during normal operations.

Die board 42 is typically constructed of laminated plywood. Die boards, such as that illustrated in FIG. 1, typically include a combination of cutting blades, creasing rules, resilient scrap strippers, resilient product ejectors and the like.

Figure 2:
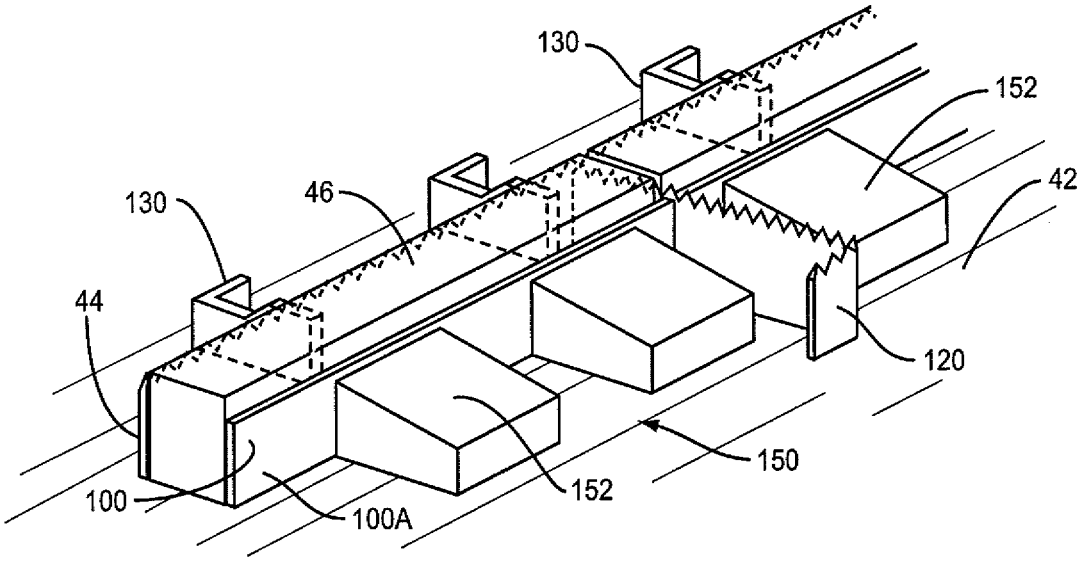
FIG. 2 is a fragmentary perspective view showing a portion of a die board of the present invention.
Figure 2A:
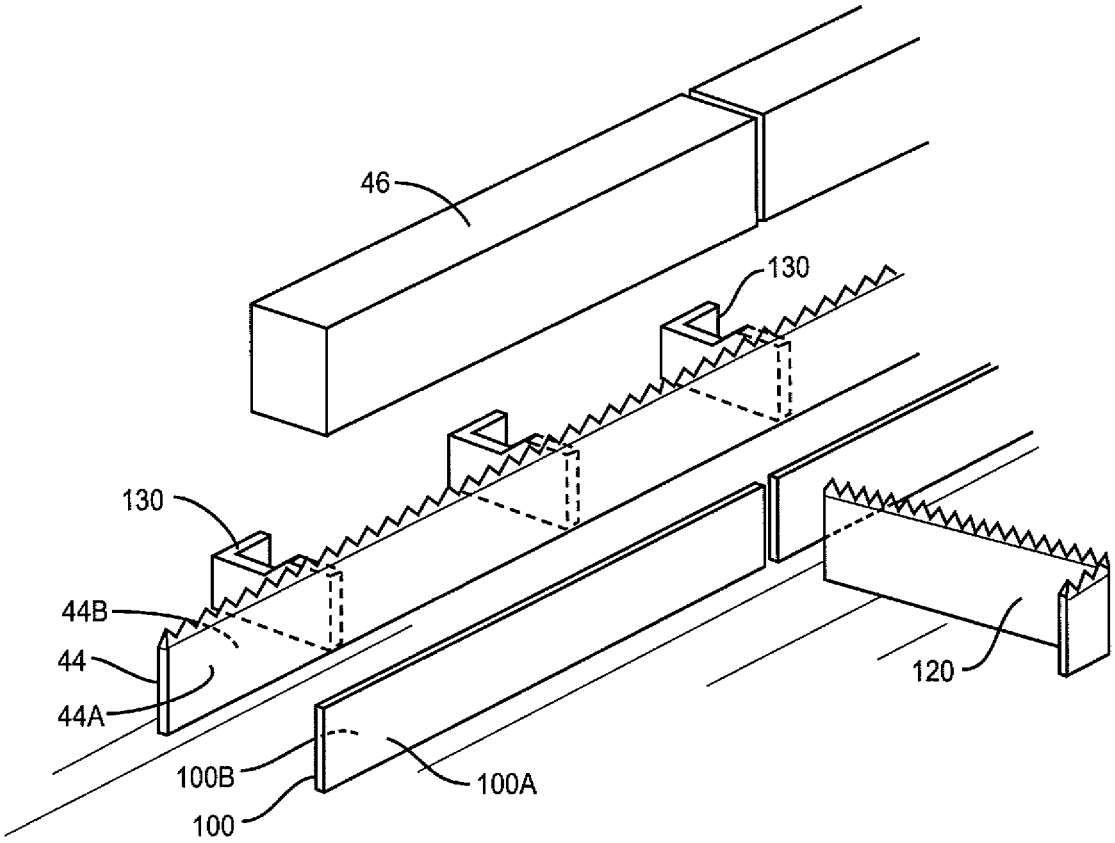
FIG. 2A is an exploded view showing portions of the trim cutting blades, trim stripper and retainer.
Figure 3:
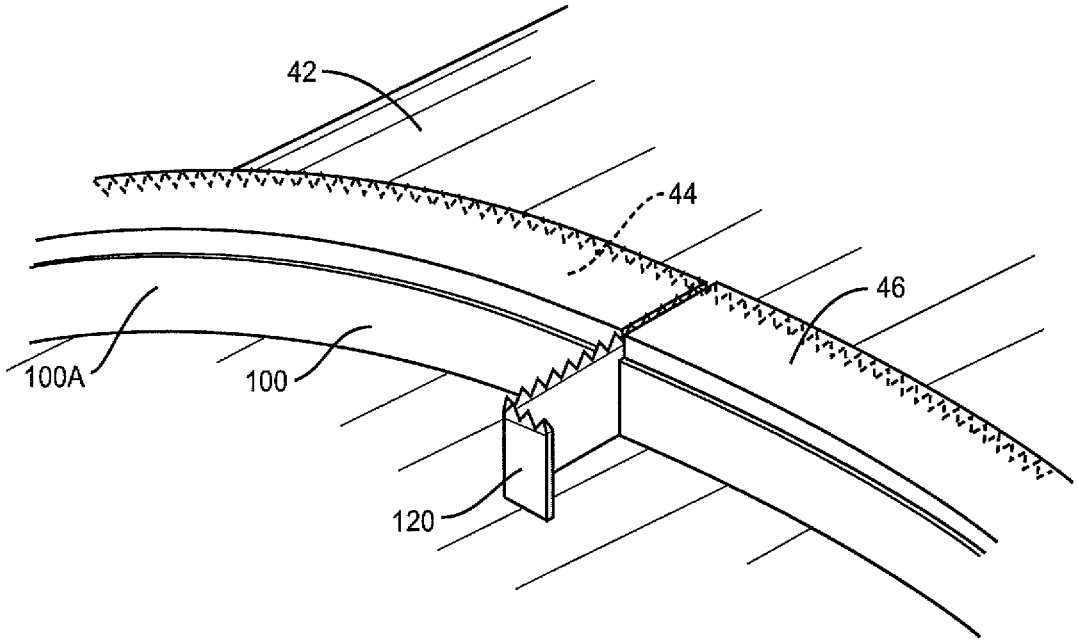
FIG. 3 is a fragmentary perspective view showing another portion of the die board of the present invention.
Figure 12A:
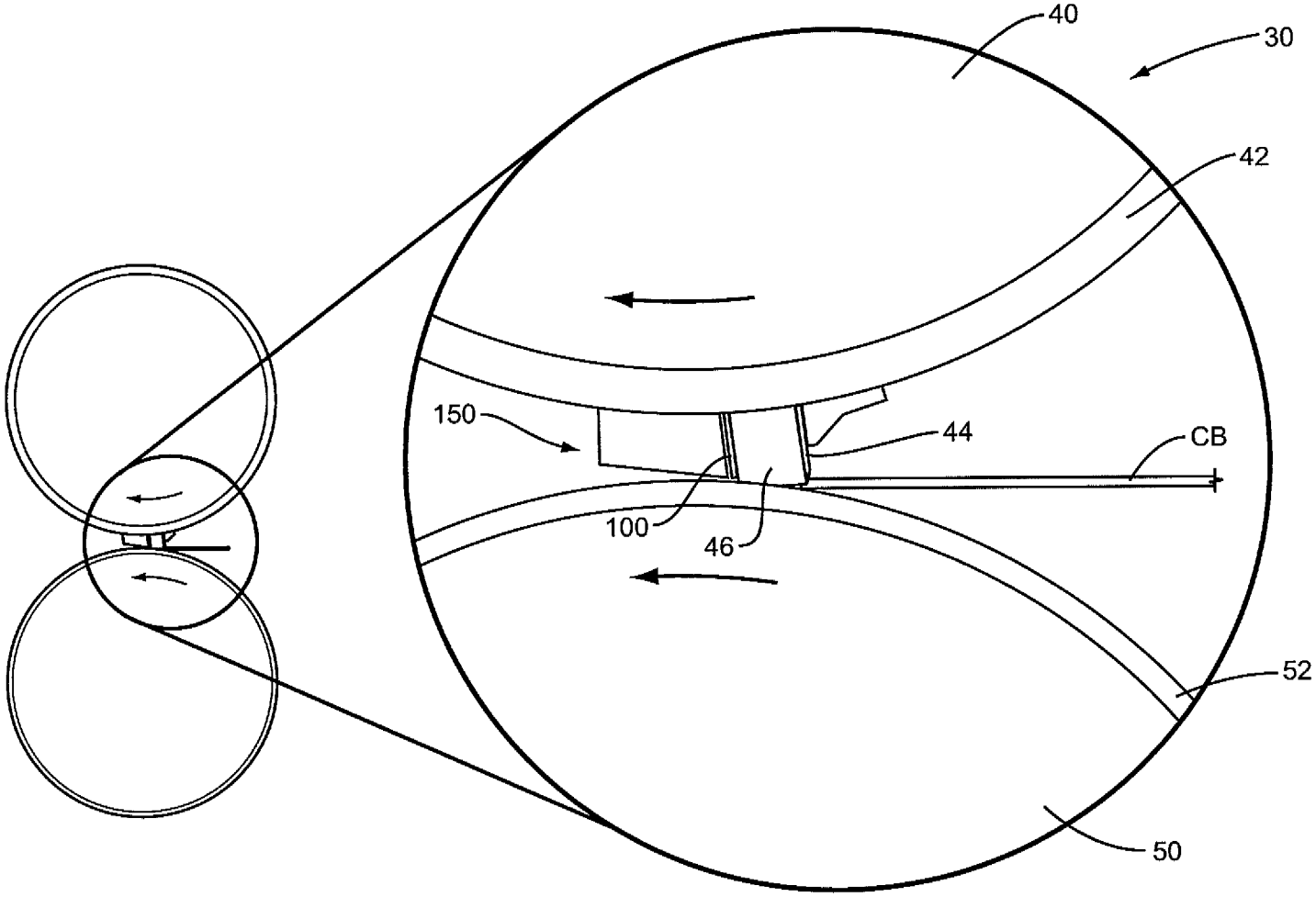
FIG. 12A is a schematic illustration showing a trim stripper beginning to pass through the nip between a die board cylinder and an anvil cylinder.
Figure 12B:
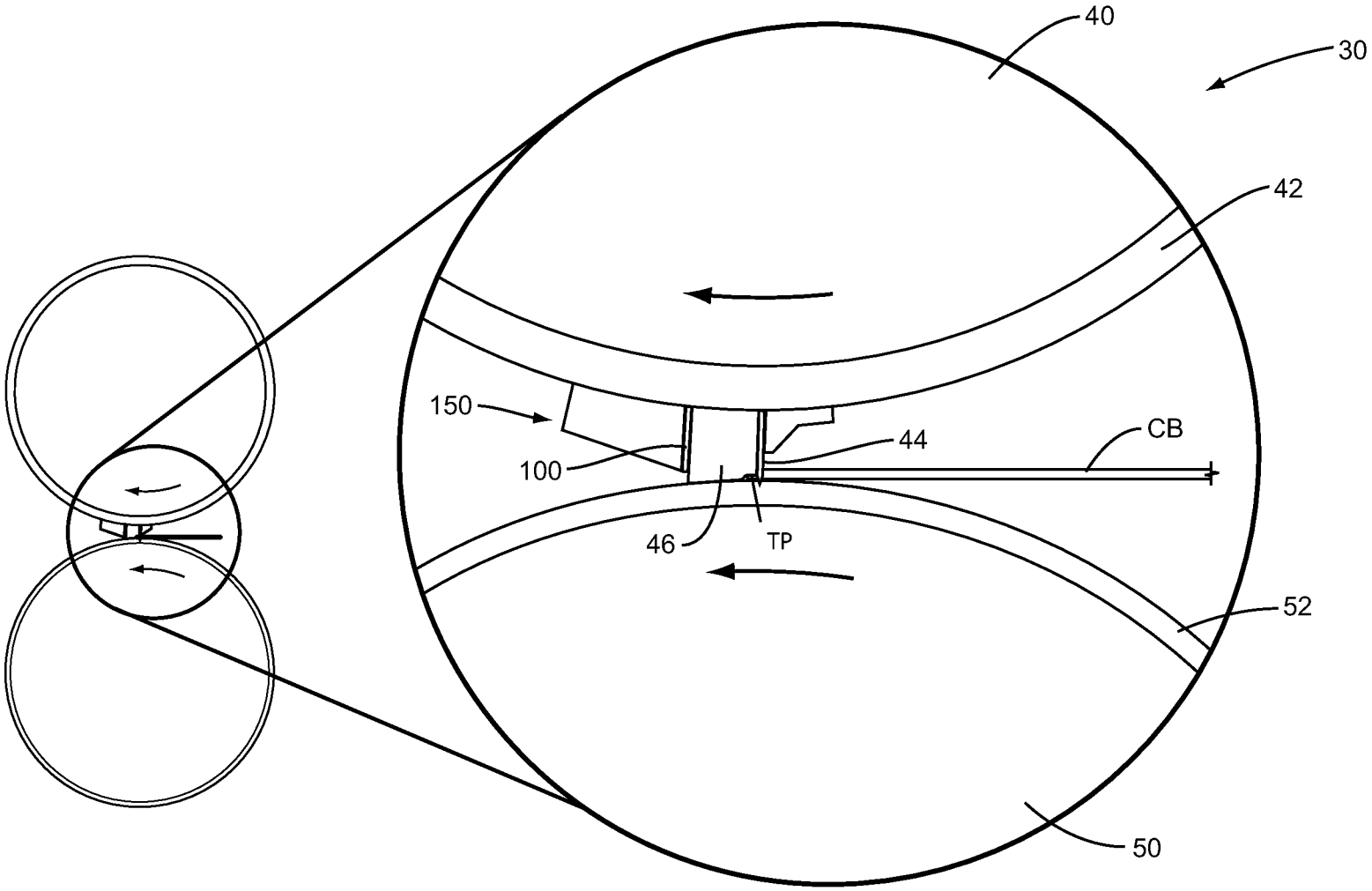
FIG. 12B is a schematic illustration showing the continued movement of the trim stripper through the nip and showing the trim stripper engaging a piece of cut trim.
Figure 12C:
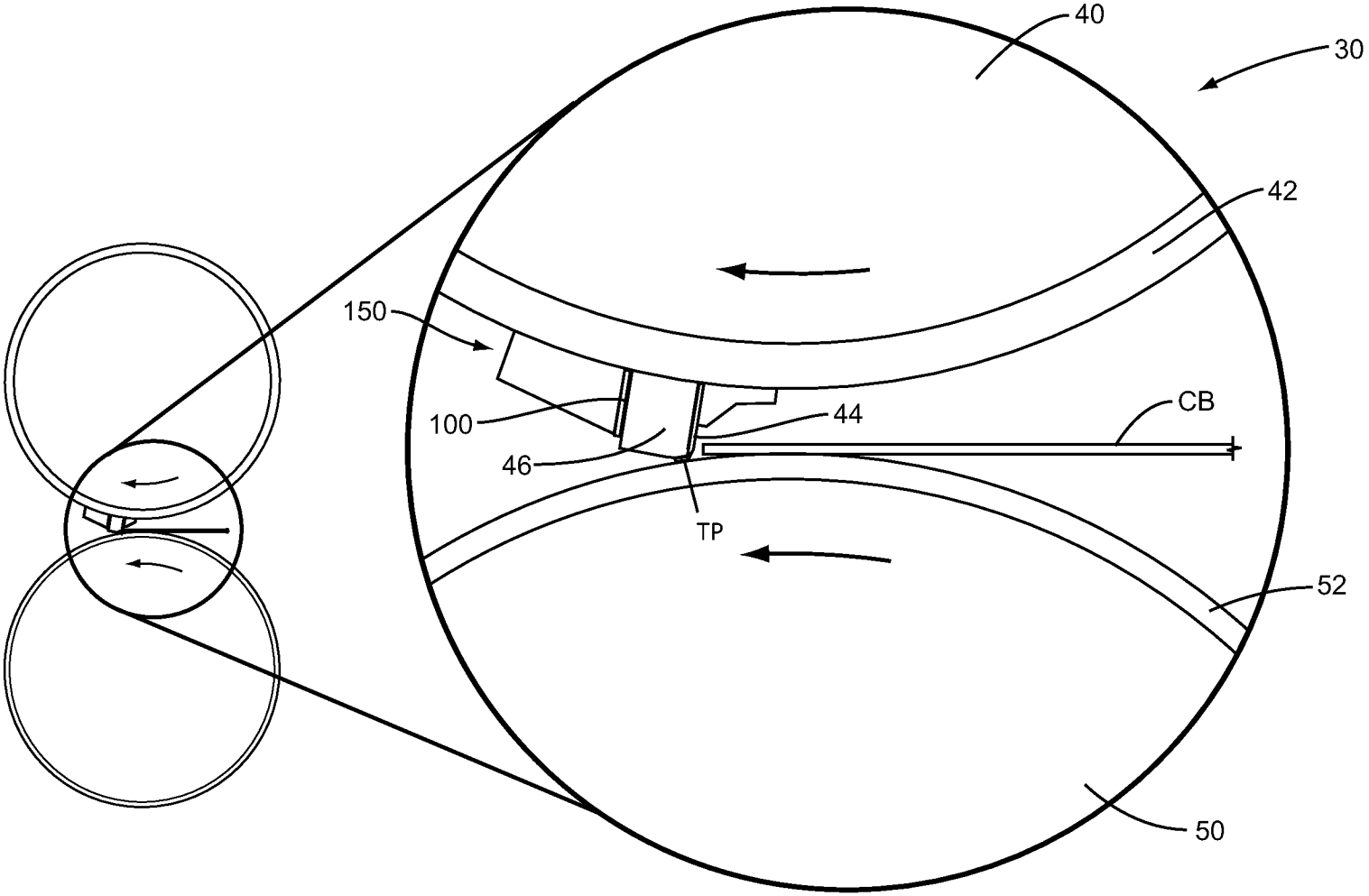
FIG. 12C is similar to FIGS. 12A and 12B and which shows the trim stripper exiting the nip, but still engaged with the cut piece of trim.
Figure 13:
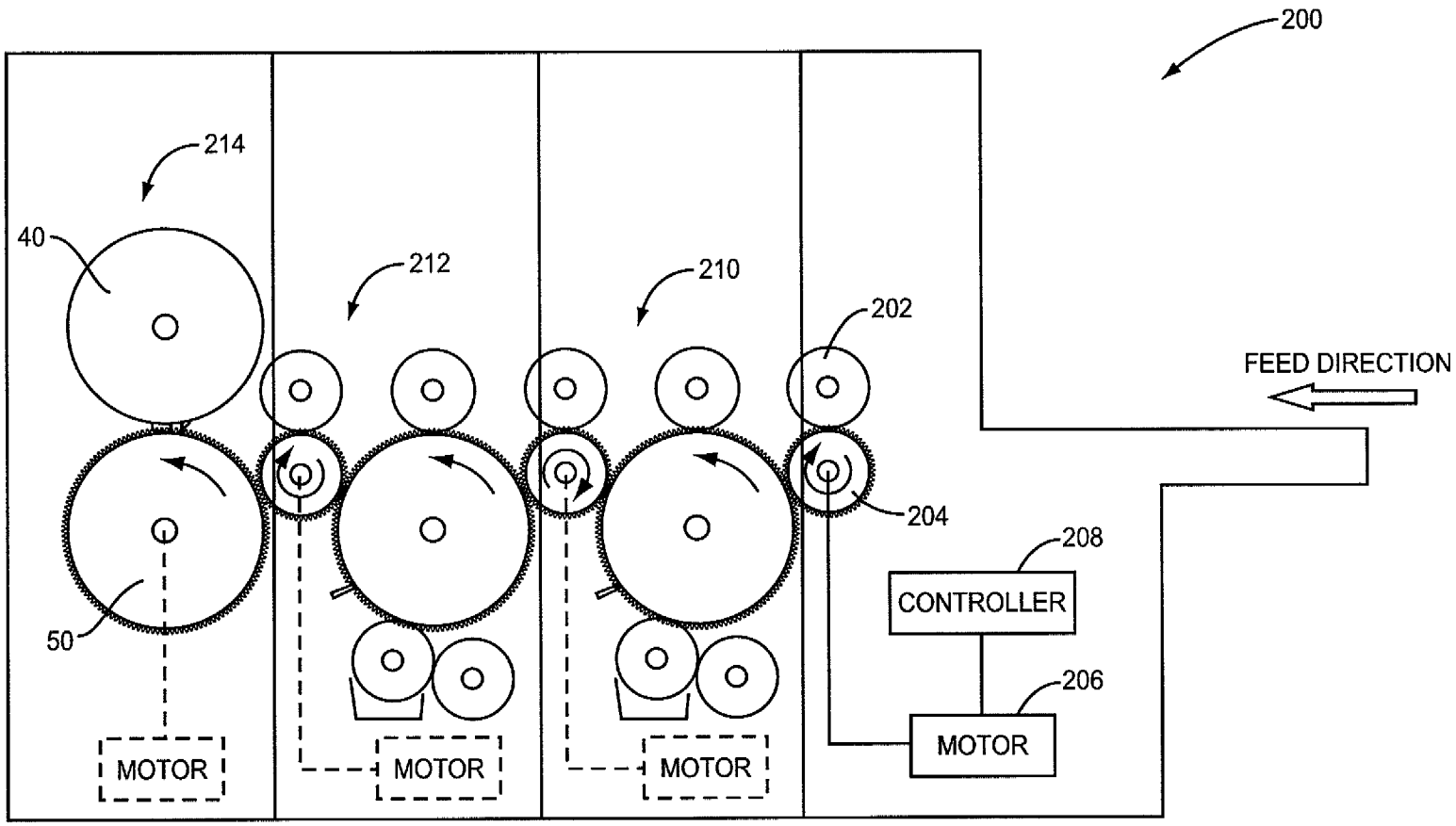
FIG. 13 is a schematic illustration of a machine that includes the rotary cuffing die assembly along with a series of printing stations.

More particularly, the die board 42 includes a series of trim cutting blades 44 which are securely mounted in the die board such that the cutting tips of the blades 44 protrude and extend generally outwardly and away from the surface of the die board cylinder 40. Trim cutting blades 44 extend generally around an area of the die board 42. For example, the trim cutting blades 44 include one or more leading trim cutting blades such as shown in FIGS. 2 and 12A, one or more side trim cutting blades such as appears in FIG. 3 and one or more trailing trim cut blades that are shown extending transversely across the lower portion of the die board 42 in FIG. 1. Each trim cutting blade 44 includes an outboard side that is referred to by 44A and an inboard side that is referred to by 44B.

Rotary cutting die apparatus 30 is designed to receive the corrugated board CB. As the corrugated board CB passes through the nip, the die cutting board and the elements thereof is effective to trim the corrugated board. That is, the trim cutting blades 44 trim small trim pieces TP from the outside edge of the corrugated board. This leaves a product board or a product portion of the corrugated board. Die board 42 and the elements thereon operate on the product portion to cut and score and form the product board into a corrugated panel that can be shaped and formed into a corrugated box or container.

The term "trim cutting blade" or "trim blade" is specifically defined as a blade that trims the corrugated board CB and cuts a piece of trim from around edge portions of the corrugated board to leave the finished die cut product. The term "trim cutting blade" or "trim blade" specifically excludes any scrap cutting blades located within the area defined by the overall length and overall width of the finished die cut product.

Disposed adjacent trim cutting blades 44 is a series of trim strippers 46. In some cases, the trim strippers 46 are referred to as elastomer trim transfer devices. The trim strippers 46 are positioned adjacent the outboard side 44A of the trim cutting blades 44. They function to engage the cut trim pieces TP cut from the corrugated board CB by the trim cutting blades 44 and direct the cut trim pieces away from the trim cutting blades and away from the product portion of the corrugated board CB. Trim strippers 46 can assume various shapes. In the embodiment illustrated herein, the trim strippers 46 are generally elongated and are generally rectangular or square in cross section. The trim strippers 46 are resilient and compressible and are typically manufactured from a resilient material such as a urethane having a durometer of 85 on a Shore 00 scale and having a density of approximately 45 g/cm$^3$.

For purposes of explanation, each trim stripper 46 includes an outboard side 46A and an inboard side 46B. Inboard side 46B is set directly adjacent the outboard side 44A of a trim cutting blade 44. This is true for all of the trim cutting blades 44 irrespective of their location on the die board 42. That is, in the case of the leading trim cutting blade (FIG. 2), the trim stripper or strippers 46 is disposed directly adjacent the outboard side 44A of the trim cutting blade 44. Likewise, for side and trailing trim cutting blades, the trim strippers 46 are disposed on the outside thereof such that the inboard side 46B of the trim strippers engage and rest against the outboard side 44A of the trim cutting blades.

As discussed above, in conventional rotary cutting dies there is a tendency for the trim strippers to bow. That is, as the die board rotates and the trim strippers engage cut trim as well as the anvil, the trim strippers tend to bow, leaving a gap between the trim strippers and the outboard side of the trim cutting blades. This results in the inboard side of the trim stripper moving away from the adjacent trim cutting blade. Often, this leaves the gap between the trim cutting blade and the trim stripper. Over a period of time, small cut pieces of trim tend to wedge themselves between the trim cutting blade and the adjacent trim stripper. This over time causes substantial forces to be applied against the blade and ultimately the die board, often resulting in damage to the die board.

Figure 4:
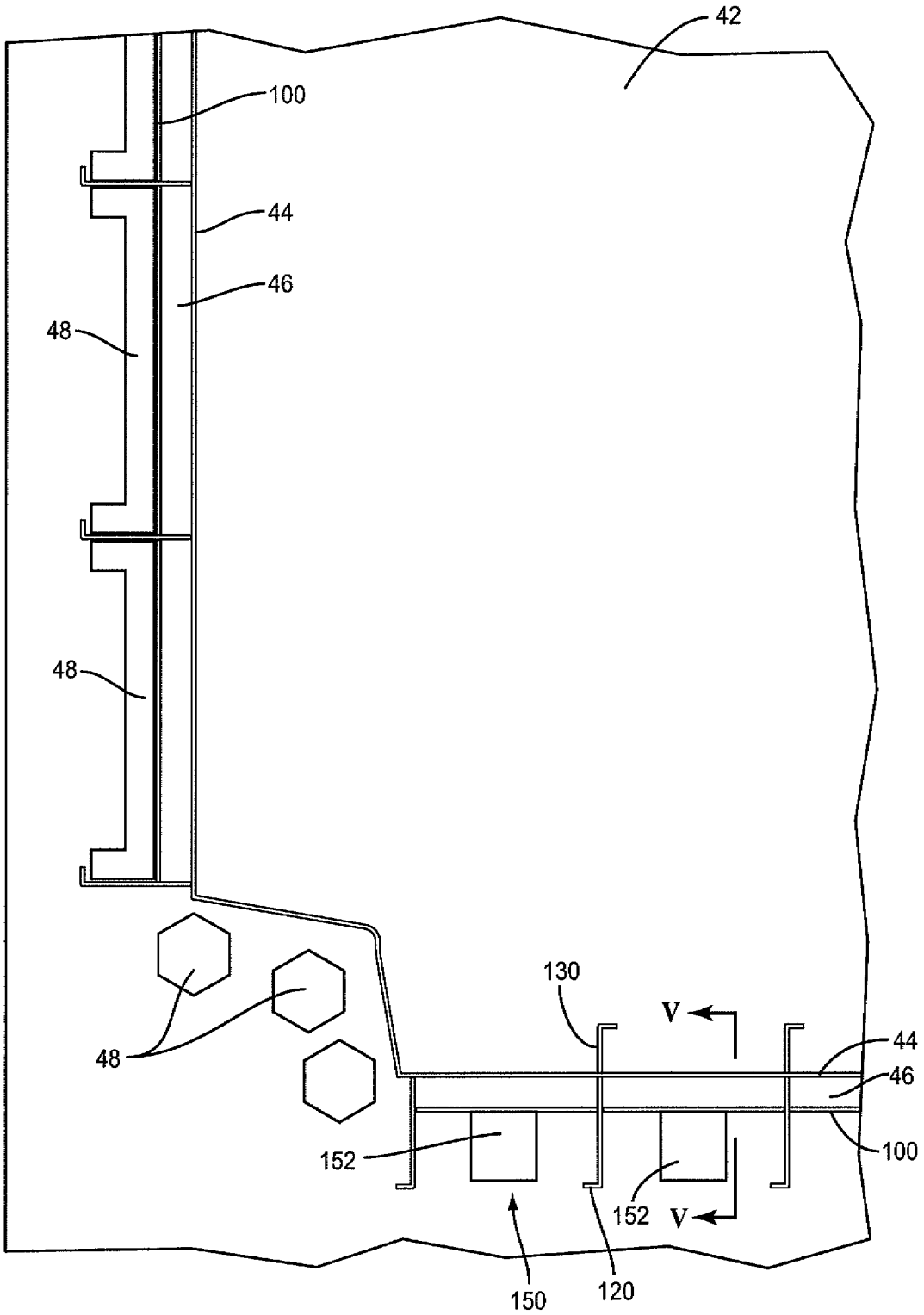
FIG. 4 is a fragmentary plan view showing a portion of the die board of the present invention.
Figure 5:
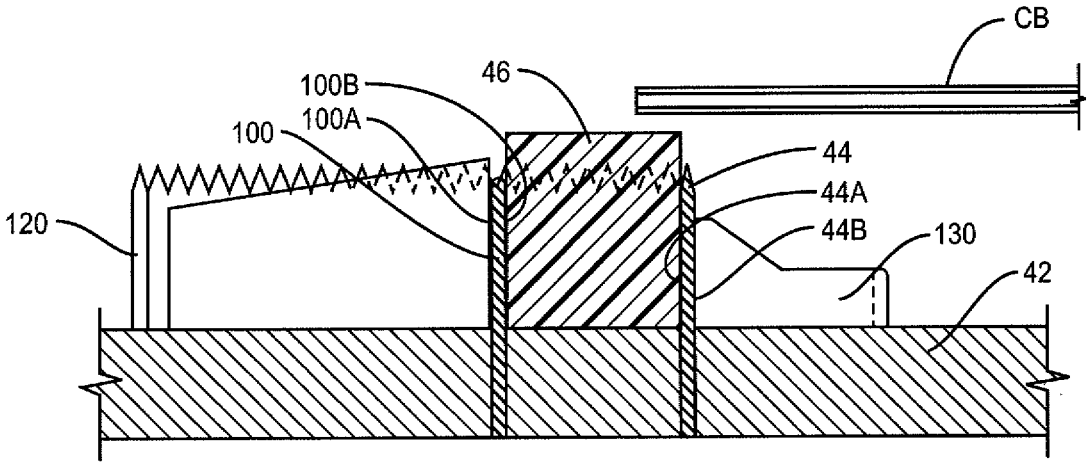
FIG. 5 is a sectional view taken through the line V-V of FIG. 4.

In addition to the trim strippers 46 just discussed, also provided are secondary trim strippers 48. As illustrated in FIG. 4, the secondary trim strippers 48 are disposed outside the trim cutting blades 44. Secondary trim strippers 48 can be placed at various locations on the die board 42. In general, as illustrated in FIG. 4, the secondary trim strippers 48 are disposed outside of the trim cutting blades 44 and as illustrated in FIG. 4 in this one example the secondary trim strippers 48 include a series of generally U-shaped trim strippers disposed along the side of the die board and three secondary trim strippers disposed in the leading corners of the die board just outwardly of the trim cutting blades 44. The secondary trim strippers 48 may be placed along the leading edge of the die board 42, just outwardly of the leading trim cutting blades 44 and the primary trim strippers 46. Generally, the secondary trim strippers 48 are optional. Secondary trim strippers 48 may be useful during the set up and initial runs of the rotary cutting die apparatus 30. In some cases during set up and initial runs the leading trim pieces cut may be larger than would ordinarily occur during normal operations. In these cases, the secondary trim strippers 48 engage the relatively large pieces of cut trim and urge them downwardly in engagement with the anvil 50 and cause the cut trim pieces to be separated from the produced product board. For the secondary trim strippers 48, conventional trim stripping material can be used. In one embodiment it is contemplated that the material used for the secondary trim strippers 48 would be less dense than the material used for trim strippers 46.

The present invention provides a retainer 100 for engaging the trim strippers 46 and maintaining the trim strippers closely adjacent the trim cutting blades 44 so that the tendency for a gap to occur between the trim strippers and the trim cutting blades is reduced or eliminated. Therefore, as seen in the drawings, a series of retainers 100 is mounted in the die board outside of the trim cutting blades 44 and outside of the trim strippers 46. As seen in the drawings, the retainers are spaced so as to closely confine the trim strippers 46 between the trim cutting blades 44 and the retainers 100. The retainers 100 include an outboard side 100A and an inboard side 100B. The retainers 100 are positioned flush against the outboard side 46A of the trim strippers 46. The purpose of the retainers 100 is to hold the trim strippers 46 closely adjacent the outboard side of the trim cutting blades 44. This confines the trim strippers 46 between the trim cutting blades 44 and the retainers 100. This prevents the trim strippers 46 from bowing and leaving a gap between the trim strippers and the trim cutting blades 44.

Figure 6:
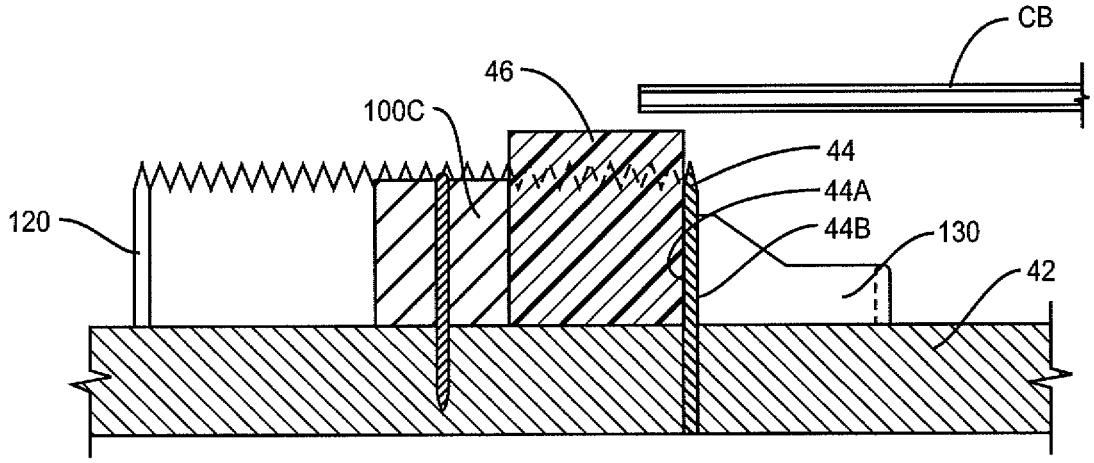
FIG. 6 is a sectional view similar to FIG. 5, but showing a block of wood used as the retainer.

Retainers 100 can take various forms. In one embodiment, the retainers comprise a series of scoring or cutting rules mounted in the die board 42. In another embodiment, the retainer 100 can assume the form of a block object secured on the die board 42. For example, the block object could be surface mounted to the die board 42. In one particular example, the retainer is a block of wood that is stapled, glued or otherwise fastened to the die board 42. This is illustrated in FIG. 6 and the block of wood is indicated at 100C. Discussed subsequently herein are preloading devices 150. The preloading device subsequently discussed herein could be utilized as a retainer for retaining the trim strippers 46 in a space defined generally between the trim cutting blades 44 and the preloading devices. Other forms and types of retainers may be used. The retainers 100 should be sufficiently strong enough and of a height to retain the trim strippers 46 and maintain the trim strippers closely adjacent the respective trim cutting blades 44.

Figure 7:
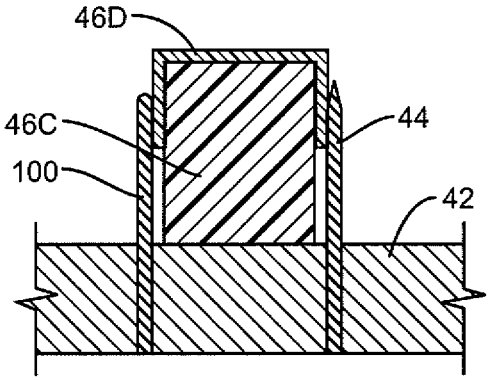
FIG. 7 is a fragmentary sectional view showing an alternative design for a trim stripper.
Figure 8:
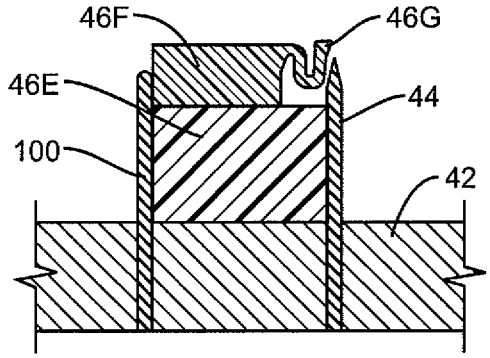
FIG. 8 is a fragmentary sectional view showing another alternative design for a trim stripper.
Figure 9:
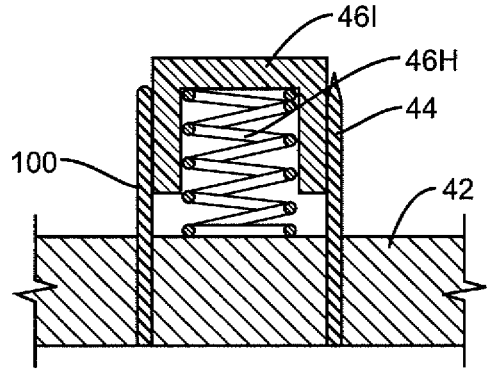
FIG. 9 is fragmentary sectional view showing still another alternative design for the trim stripper.

As pointed out above, the trim stripper 46 can assume various designs. A few exemplary designs for the trim stripper 46 are shown in FIGS. 7, 8 and 9. First, in FIG. 7, the trim stripper shown therein is still confined between the trim cutting blade 44 and the retainer 100. In this case the trim stripper includes a member 46C that can be an elastomer constructed of foam, rubber, or the like. Secured by glue or other suitable fastening means to member 46C is a cap 46D. The cap 46D assumes an inverted U-shape and includes downwardly extending sides that are confined between the retainer 100 and the trim cutting blade 44. As viewed in FIG. 7, the resilient member 46C is compressible as it passes through the nip. Cap 46D, which can be constructed of plastic or other suitable materials, moves with the compressible member 46C. Consequently, both member 46C and cap 46D move back and forth between the retainer 100 and trim cutting blade 44 as the trim stripper passes through the nip.

FIG. 8 is another example of a trim stripper design. Here the trim stripper 46 includes a resilient member 46E that is confined between retainer 100 and trim cutting blade 44. Again, member 46E can be an elastomer such as a resilient block constructed of rubber, foam or the like. Secured to the top of member 46E is a cap 46F. Cap 46F includes a resilient wiper 46G that extends from one side of the cap 46F. The wiper 46G is biased to generally engage the trim blade 44 as the trim stripper is moved back and forth within the confines of the retainer 100 and trim blade 44. Wiper 46G by engaging the outboard surface of the trim cutting blade 44 prevents cut trim from being lodged between the wiper 46G and the outboard side of the trim cutting blade 44.

FIG. 9 is another exemplary trim stripper. Here the trim stripper includes a resilient member 46H in the form of a spring. The spring is seated on the die board 42 and extends therefrom. Secured over the spring 46H is a cap 46I. Cap 46I assumes an inverted U-shape with the sides thereof extending, as viewed in FIG. 9, downwardly between the spring 46H and the retainer 100 and trim cutting blade 44. Again, as the trim stripper passes through the nip, the resilient member or spring 46H is compressed causing the cap 46I, as viewed in FIG. 9, to move downwardly. Again, the retainer 100 and trim cutting blade 44 confine the cap 46I. The retainer 100 functions to retain the cap 46I closely adjacent the outboard side of the cutting blade 44 such that cut trim is not packed or wedged between the cap 46I and the outboard side of the trim cutting blade 44.

Which further reference to the drawings, the die board 42 includes other elements that are associated with the trim cutting blades 44. For example, extending perpendicularly outwardly from the outboard side 44A of the trim cutting blades 44 is a series of trim breakers 120. Many of the trim breakers disclosed herein assume a generally L-shape on the die board 42. They may also be generally straight. The trim breakers 100 include an upper cutting edge that is effective to cut the outside trim pieces into smaller portions. Note that the trim breakers 120 generally extend from or even abut the trim cutting blades 44.

The trim cutting blades are also reinforced by a series of rule supports 130. Note in FIGS. 2 and 4 where the rule supports lie adjacent the inboard side 44B of the cutting blades 44. These rule supports 130 extend into or abut against the inboard side of the cutting blades 44 so as to support and reinforce the trim cutting blades.

Figure 10:
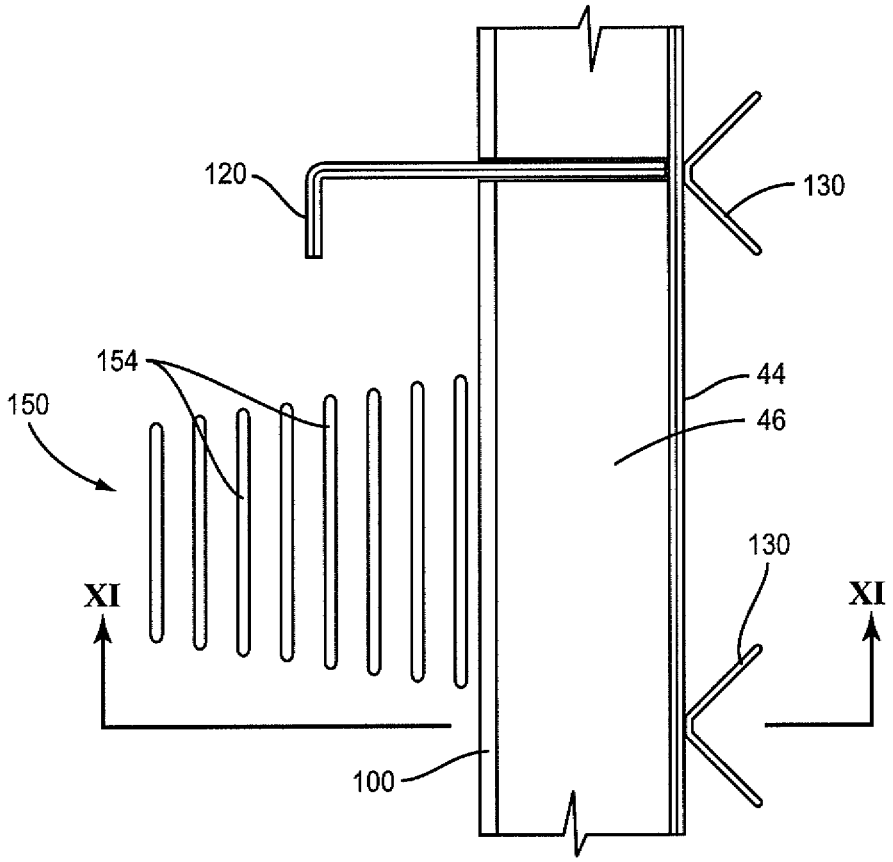
FIG. 10 is a schematic illustration of a portion of a die board including a preloading device.
Figure 11:
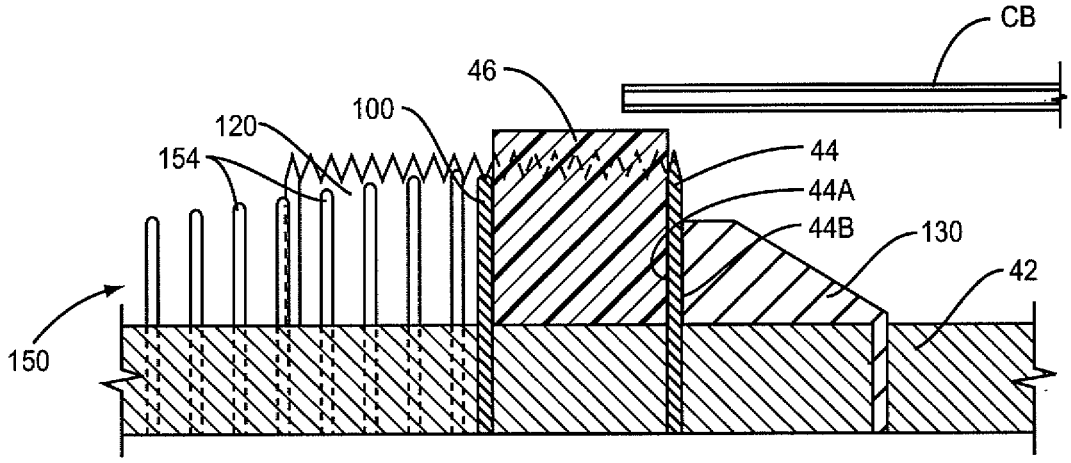
FIG. 11 is a fragmentary sectional view taken through the line XI-XI of FIG. 10.

Turning to FIG. 10 of the drawings, there is shown therein a machine for printing and die cutting corrugated board. The machine is referred to generally by the numeral 200. The machine 200, in this embodiment, includes three basic operating stations. Station 210 is a first print station and 212 refers to a second print station. Located downstream from the second print station 212 is a die cutting station indicated generally by the numeral 214. Die cutting station 214 includes the rotary die cutting apparatus 30 discussed above. That is, die cutting station 214 includes the rotary die cylinder 40, anvil cylinder 50 and die board 42. Upstream from the first print station 214 is a pair of rollers 202, 204. Roller 204 is driven by a motor that is controlled through a controller. Roller 204 has a gear associated therewith that is effective to drive the components of the first print station. The first print station 210 includes a gear network that is operative to drive the second print station which likewise has a gear network that is operative to drive the die cutting station 214. Details of the machine 10 will not be dealt with herein because such is not per se material to the present invention and further such machines are known. Suffice to say that corrugated board CB is fed into the machine from right to left, as viewed in FIG. 10. The corrugated board is fed into the nip between rollers 202 and 204 and continues generally horizontally through the first and second print stations 210 and 212 and then through the die cutting station 214. In the process, printing plates carried by the print rollers of the first and second print stations 210 and 212 are operative to print indicia, designs, etc. on the passing corrugated board. Once the corrugated board clears the second print station 212, it enters the die cutting station 214 and the die board 42 and the elements thereon trim the corrugated board and further cut and act on the remaining product board.

In the example shown in FIG. 10, each station 210, 212 and 214 includes a dedicated motor for assisting and powering the respective stations. However, in many of the machines similar to that shown in FIG. 10, the multiple stations are powered by a single motor that drives an initial roller such as roller 204 at the inlet end of the machine. In this case particularly, the printing process is sometimes encumbered by abrupt loads that are repeatedly placed on the components of the die cutting station 214. In particular, when the leading trim cutting blade comes into contact with the corrugated board, there is an abrupt load placed on the rotary die cylinder 40. This for just a moment causes a hesitation in the upstream drive system. This hesitation is just enough to cause a small ink smudge at a particular point or area on the corrugated board.

The present invention entails a die board that is designed to avoid the abrupt loads caused by the leading trim blades on each revolution of the rotary die cylinder 40.

The present invention entails one or more preloading devices, indicated generally by the numeral 150 mounted on the die board 42 just ahead of the leading trim cutting blades 44. Essentially the preloading devices 150 provide a gradual load to the rotary die cutting apparatus 30 prior to the leading trim cutting blades 44 engaging the corrugated board and cutting the trim against the anvil 50.

The preloading devices can be designed and arranged in various ways. In the present application, each preloading device includes one or more ramps that are aligned with the leading trim cutting blades 44 and spaced ahead of the trim cutting blades. That is, as seen in FIGS. 2, 4, 6 and 7, the preloading devices 150 include a ramp-like structure that is inclined such that the upper surfaces of the ramps are inclined outwardly from the die board 42 in the general direction of the leading trim cutting blades 44.

In the case of the embodiment shown in FIG. 2, the preloading devices are in the form of a compressible ramp structure that is made of urethane or hard or semi-hard rubber. Various materials can be used for the ramps. In one embodiment the preloading ramp, such as shown in FIG. 2, comprises a urethane generally described as Shore A, durometer 85-87. These ramps include side edges and an upper inclined surface. Note that as viewed in FIG. 2, the upper inclined surface of each preloading device is inclined upwardly in the direction of the leading trim cutting blades 44. Thus, on each revolution of the rotary die cylinder 40, these ramps or preloading devices 150 will engage the anvil 50 ahead of the leading trim cutting blades 44 so as to gradually load the rotary die board cylinder 40. This gradual loading of the cylinder 40 will prevent abrupt loading and will reduce the tendency of the printing stations to cause ink smudges instantaneously at the time of abrupt loading.

The preloading ramps can assume various forms. In an alternative design shown in FIG. 7, the preloading device 150 includes a series of upstanding elements 154. This is referred to as a segmented ramp because it is not continuous or does not include a continuous upper surface. Various types of elements can be employed. In one embodiment, the various elements comprising the preloading device in FIGS. 6 and 7 is a series of scoring rules with their heights varying. As viewed in FIGS. 6 and 7, the height of the respective elements of the segmented ramp, generally become taller or higher towards the retainer 100 and trim stripper 46. Again, the elements that make up the segmented ramp shown in FIGS. 6 and 7 will effectively gradually preload the die board cylinder 40. In some cases, the various elements of the segmented ramp can be turned 90° or at other angles from that shown in FIGS. 6 and 7. The length of the respective segments can vary.

FIGS. 9A, 9B and 9C are a sequence of views showing how the retainer 100 confines the trim stripper 46 and prevents a gap from occurring between this trim stripper and a trim cutting blade 44. Further, the sequence of drawings illustrates how the preloading device 150 preloads the die board cylinder 40 to prevent abrupt loading.

In FIG. 9A, the corrugated board is fed into the nip and at the point shown therein, the trim cutting blade is disposed at a point where it is about to engage the corrugated board CB and cut a piece of trim from the leading edge of the corrugated board. At this point, a portion of the trim stripper 46 has engaged the trim piece and has been partially compressed.

In FIG. 9B the trim cutting blade 44 has severed the trim piece and the trim piece is held against the surface of the anvil 50 by the trim stripper 46. Note that the retainer 100 has confined the trim stripper 46 between the retainer and the trim cutting blade 44 such that a gap does not appear between the trim stripper and the trim cutting blade. Thus, the piece of cut trim cannot be wedged between the trim stripper 46 and the trim cutting blade 44.

FIG. 9C shows a continuation of the process where the trim stripper 46 remains engaged with the cut piece of trim TP and is holding the cut piece of trim against the surface of the anvil 50 so as to separate the trim from the following product board. As the process continues, the trim stripper 46 will continue to hold the cut piece of trim against the surface of the anvil until it is released. At the point of the release, the cut trim TP is at a position where the anvil will tend to direct the cut piece of trim downwardly and to the left as viewed in FIG. 9C. This separates the cut trim from the product board. This same process occurs around the die board 42 and around the various cutting blades 44 utilized. The trim strippers 44 are maintained closely adjacent trim cutting blades 44 such that pieces of trim cannot be wedged or jammed into an opening or gap that occurs between the trim stripper 46 and the trim cutting blades 44.

There are many advantages to the die board 42 of the present invention. The use of the retainers 100 to confine the trim strippers 46 between the trim cuffing blades 44 and the retainers generally preclude cut trim pieces from being wedged and packed between the trim cutting blades and the trim strippers. In addition, with the retainers 100, taller and firmer stripping material can be employed along the leading edge of the die board. This provides better separation of cut trim pieces from the product board, and as a result less trim pieces end up with the product.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A rotary cutting die adapted to be mounted on a rotary die cylinder for cutting corrugated board fed between the cutting die and an anvil disposed adjacent the cutting die and rotary die cylinder, the rotary cutting die comprising:

a. a die board configured to fit on the rotary die cylinder;

b. a trim cutting blade mounted on the die board for cutting an outside trim piece from a sheet of corrugated board to yield a die cut product;

c. the trim cutting blade having an outboard side and an inboard side and disposed and positioned on the die board for cutting an outer overall dimension of the die cut product;

d. an elastomer trim transfer device secured to the die board adjacent the outboard side of the trim cutting blade for engaging a cut trim piece and separating the cut trim piece from the die cut product;

e. the elastomer trim transfer device having an outboard side and an inboard side and wherein the elastomer trim transfer device is secured to the die board directly adjacent the trim cutting blade such that the inboard side of the elastomer trim transfer device faces the outboard side of the trim cutting blade;

f. a retainer for engaging the elastomer trim transfer device and causing the elastomer trim transfer device to be held closely adjacent the outboard side of the trim cutting blade so as to generally prevent the cut trim piece from being wedged between the outboard side of the trim cutting blade and the inboard side of the elastomer trim transfer device;

g. the retainer being mounted on the die board such that the retainer confines the elastomer trim transfer device between the retainer and the outboard side of the trim cutting blade; and h. wherein the elastomer trim transfer device is movable back and forth within a space defined between the retainer and the trim cutting blade.

2. The rotary cutting die of claim 1 including a plurality of trim cutting blades and a plurality of retainers, wherein the trim cutting blades and the retainers are disposed in spaced apart relationship and extend around a substantial portion of the die board so as to at least partially enclose an area on the die board.

3. The rotary cutting die of claim 1 wherein the trim cutting blade includes at least one leading trim cutting blade that extends transversely across a portion of the die board; and wherein the rotary cutting die includes at least one preloading device mounted on the die board ahead of the leading trim cutting blade for engaging the anvil and preloading the rotary die cylinder prior to the leading trim cutting blade loading the die cylinder.

4. The rotary cutting die of claim 3 wherein the preloading device includes a ramp secured to the die board ahead of the leading trim cutting blade.

5. The rotary cutting die of claim 4 wherein the ramp includes a variable depth and wherein the depth of the ramp generally increases in the direction of the leading trim cutting blade.

6. The rotary cutting die of claim 4 wherein each ramp includes an upper surface that is generally inclined outwardly from the die board in the general direction of the leading trim cutting blade.

7. The rotary cutting die of claim 1 including a preloading device mounted on a leading area of the die board for engaging the anvil on each revolution of the rotary die cylinder and preloading the rotary die cylinder.

8. The rotary cutting die of claim 7, wherein the preloading device is mounted ahead of a leading trim cutting blade such that the rotary die cylinder is preloaded on each revolution prior to the leading trim cutting blade loading the rotary die cylinder.

9. The rotary cutting die of claim 1 wherein the rotary cutting die includes a plurality of trim blades disposed and positioned on the die board for cutting the outer overall dimensions of the die cut product and for cutting trim extending completely around an outer edge of the corrugated board fed between the cutting die and anvil.

10. A rotary cutting die adapted to be mounted on a rotary die cylinder for cutting corrugated board fed between the cutting die and an anvil disposed adjacent the cutting die and rotary die cylinder, the rotary cutting die comprising:

a. a die board configured to fit on the rotary die cylinder;

b. a trim cutting blade mounted on the die board for cutting an outside trim piece from a sheet of corrugated board to yield a die cut product;

c. the trim cutting blade having an outboard side and an inboard side and disposed and positioned on the die board for cutting an outer overall dimension of the die cut product;

d. an elastomer trim transfer device secured to the die board adjacent the outboard side of the trim cutting blade for engaging the trim piece and transferring the trim piece away from the trim cutting blade;

e. the elastomer trim transfer device having an outboard side and an inboard side and wherein the elastomer trim transfer device is secured to the die board directly adjacent the trim cutting blade such that the inboard side of the elastomer trim transfer device faces and engages the outboard side of the trim cutting blade;

f. a preloading device mounted on a leading area of the die board for engaging the anvil on each revolution of the rotary die cylinder and preloading the rotary die cylinder; and g. wherein the trim cutting blade is a leading trim cutting blade and is disposed transversely across the die board and wherein the preloading device is aligned with the trim cutting blade and disposed ahead of the trim cutting blade such that on each revolution of the rotary die cylinder, the preloading device engages the anvil and preloads the rotary die cylinder prior to the leading trim cutting blade loading the rotary die cylinder.

11. The rotary cutting die of claim 10, wherein the rotary cutting die forms a part of a die cutting station that is preceded by one or more print stations and wherein the die cutting station and the one or more print stations are operative to print on the corrugated board and to trim and cut the corrugated board as the corrugated board passes through the one or more print stations and the die cutting station; and wherein the die cutting station is driven in part at least by one or more components of at least one print station and wherein the preloading device generally reduces the tendency of the leading trim cutting blade to abruptly load the rotary die cylinder of the die cutting station and cause the one or more print stations to smear or smudge ink in response to the leading trim cutting blade abruptly loading the rotary die cylinder.

12. The rotary cutting die of claim 10 wherein the rotary cutting die includes a plurality of trim blades disposed and positioned on the die board for cutting the outer overall dimensions of the die cut product and for cutting trim extending completely around an outer edge of the corrugated board fed between the cutting die and anvil.

13. A rotary cutting die adapted to be mounted on a rotary die cylinder for cutting corrugated board fed between the cutting die and an anvil disposed adjacent the cutting die and rotary die cylinder, the rotary cutting die comprising:

a. a die board configured to fit on the rotary die cylinder;

b. a trim cutting blade mounted on the die board for cutting an outside trim piece from a sheet of corrugated board to yield a die cut product;

c. the trim cutting blade having an outboard side and an inboard side and disposed and positioned on the die board for cutting an outer overall dimension of the die cut product;

d. a resilient trim transfer device disposed on the die board adjacent the outboard side of the trim cutting blade for engaging a cut trim piece and separating the cut trim piece from the die cut product;

e. the resilient trim transfer device having an outboard side and an inboard side wherein the resilient trim transfer device is disposed on the die board directly adjacent the trim cutting blade such that the inboard side of the resilient trim transfer device faces the outboard side of the trim cutting blade;

f. a retainer for engaging the resilient trim transfer device and causing the resilient trim transfer device to be held closely adjacent the outboard side of the trim cutting blade so as to generally prevent the cut trim piece from being wedged between the outboard side of the trim cutting blade and the inboard side of the resilient trim transfer device;

g. the retainer being mounted on the die board such that the retainer confines the resilient trim transfer device between the retainer and the outboard side of the trim cutting blade; and h. wherein the resilient trim transfer device is movable back and forth within a space defined between the retainer and trim cutting blade.

14. The rotary cutting die of claim 8 wherein the rotary cutting die includes a plurality of trim blades disposed and positioned on the die board for cutting the outer overall dimensions of the die cut product and for cutting trim extending completely around an outer edge of the corrugated board fed between the cutting die and anvil.

* * * * *